United States Patent [19]

Albright et al.

[11] 4,324,396

[45] Apr. 13, 1982

[54] SHEET SEPARATING AND FEEDING APPARATUS

[75] Inventors: David B. Albright, Stratford, Conn.; Joseph A. Conti, Whitestone, N.Y.

[73] Assignee: Pitney Bowes Inc., Stamford, Conn.

[21] Appl. No.: 148,866

[22] Filed: May 12, 1980

[51] Int. Cl.[3] ..... B65H 3/52

[52] U.S. Cl. ..... 271/125; 271/274

[58] Field of Search ..... 271/124, 125, 121, 122, 271/34, 35, 274, 273

[56] References Cited

U.S. PATENT DOCUMENTS

| | | | |
|---|---|---|---|
| 2,368,519 | 1/1945 | Burckhardt et al. | 271/125 X |
| 2,635,874 | 4/1953 | LaBore | 271/125 X |
| 3,991,998 | 11/1976 | Banz et al. | 271/125 |

*Primary Examiner*—Bruce H. Stoner, Jr.

*Attorney, Agent, or Firm*—Donald P. Walker; William D. Soltow; Albert W. Scribner

[57] ABSTRACT

In apparatus for separating and feeding sheets, which includes a sheet feeding deck, a sheet separating stone and structure for carrying the stone in overhanging relationship with respect to the deck. There is provided an improvement for controlling the height of the stone above the deck. The improvement includes a movable frame connected to the stone carrying structure, a manually rotatable shaft connected so as to threadably engage the frame for moving the same to move the stone to a selected height above said deck, and apparatus for permitting the shaft to be pushed, without rotating the same, for raising the stone above the selected height.

8 Claims, 3 Drawing Figures

SHEET SEPARATING AND FEEDING APPARATUS

BACKGROUND OF THE INVENTION

In sheet separating and feeding apparatus of, for example, the type shown in U.S. Pat. No. 2,635,874, issued Apr. 21, 1953 to LaBore et al and assigned to the assignee of the present invention, there is provided structure for manually incrementally adjusting the sheet feeding gap between the bottoms of a plurality of sheet separating stones and a feed deck, to accommodate the change in thickness, from stack to stack, of the sheets in respective stacks of sheets of substantially uniform thickness. As shown in FIG. 2 of LaBore et al Patent, the structure for adjusting the sheet feeding gap generally includes a four bar linkage system having a link which is adapted for carrying the sheet separating stones, a compression spring having one end seated against the housing and the other end connected for downwardly urging the stones carrying link, and a manually rotatable shaft which is threadably attached to the stone carrying link for moving the same, and thus the sheet separating stones, upwardly against the compression of the spring in order to widen the gap, and downwardly toward the deck to narrow the gap. Although the sheets which are slightly thicker than the opening afforded by the adjusted width of the sheet feeding gap are automatically accommodated, due to such sheets tending to upwardly displace the sheet separating stones against the compression of the spring, the operator is required to intervene to assist such upward displacement in the event that an unusually thick sheet is inadvertently or in certain instances purposely included in a given stack of sheets. In this connection, it is noted that it is the usual practice in Great Britain, due to the British postal rate break structure being different than it is in the United States, to consistently feed mailpieces of more widely varying thickness than is the usual practice in the United States. Thus, as shown in FIG. 2 of the LaBore et al Patent, the aforesaid gap adjusting structure additionally includes a knob attached to the stone adjusting shaft to facilitate manually lifting the stones, against the compression of the spring, for temporarily widening the gap sufficiently to accommodate the passage of thicker sheets which cannot fit beneath the separating stones, or sheets which fail to displace the stones for feeding purposes.

Experience has shown that machine operators often find it difficult to exert sufficient pulling force on the shaft lifting knob to raise the separating stones against the compression of the spring, as a result of which excessively long delays may be experienced in the course of feeding some stacks of sheets. To facilitate more rapidly raising the sheet separating stones, lifting handles have been provided to afford some mechanical advantages; for example as shown in pending U.S. Patent Application Ser. No. 937,807, filed Aug. 29, 1978 by J. A. Conti and N. A. Pierce and assigned to the assignee of the present invention. On the other hand, the prior art appears to be silent with regard to the provision of structure which includes a single shaft that is adapted to be pushed, for temporarily widening the sheet feeding gap to accommodate overly thick sheets, and rotated for selectively adjusting the gap to a predetermined width to accommodate the sheets which are of substantially the same thickness in a given stack of sheets. Accordingly:

An object of the present invention is to provide improved sheet separating and feeding apparatus;

Another object is to provide sheet separating and feeding apparatus which includes improved means for adjusting the sheet feeding gap between the sheet separating stones and feed deck; and Another object is to provide sheet separating and feeding apparatus which includes improved means for rapidly raising the sheet separating stones to accommodate feeding thicker-than-usual sheets.

SUMMARY OF THE INVENTION

In apparatus for separating and feeding sheets, wherein the apparatus includes a sheet feeding deck, a sheet separating stone and means for carrying the stone in overhanging relationship with respect to the deck, there is provided an improvement for controlling the height of the stone above the deck. The improvement comprises: frame means connected to said stone carrying means for movement of said stone; stone height adjusting means, including a manually rotatable shaft threadably engaging the frame means for moving the frame means so as to move the stone to a selected height above said deck; and means for permitting the shaft to be pushed without rotation thereof to raise the stone above the selected height.

BRIEF DESCRIPTION OF THE DRAWINGS

As shown in the drawings, wherein like reference numerals designate like or corresponding parts throughout the several figures.

DESCRIPTION OF THE PREFERRED EMBODIMENTS

Figure 1:
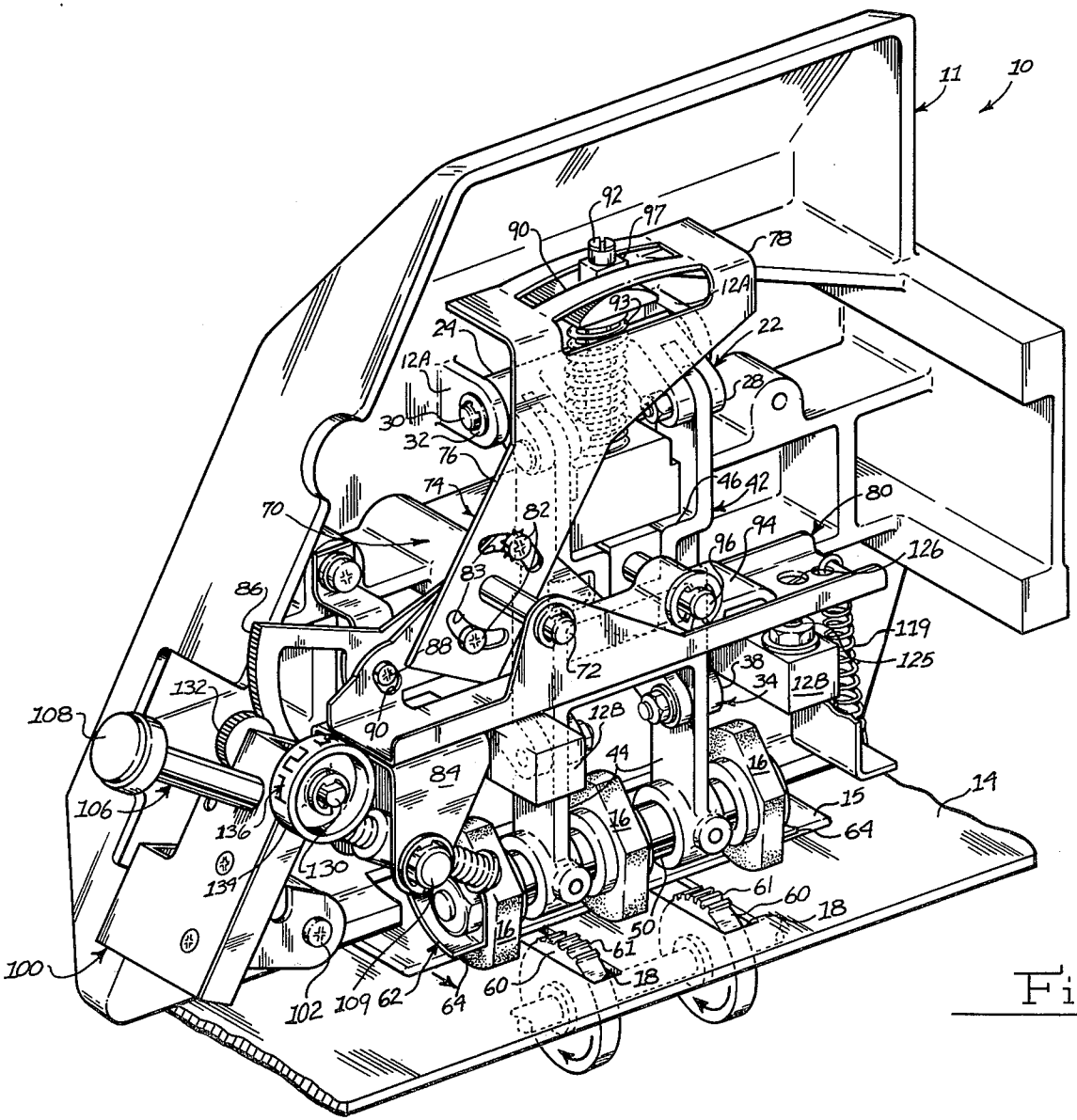
FIG. 1 is a fragmentary, perspective view of sheet separating and feeding apparatus according to the invention.
Figure 2:
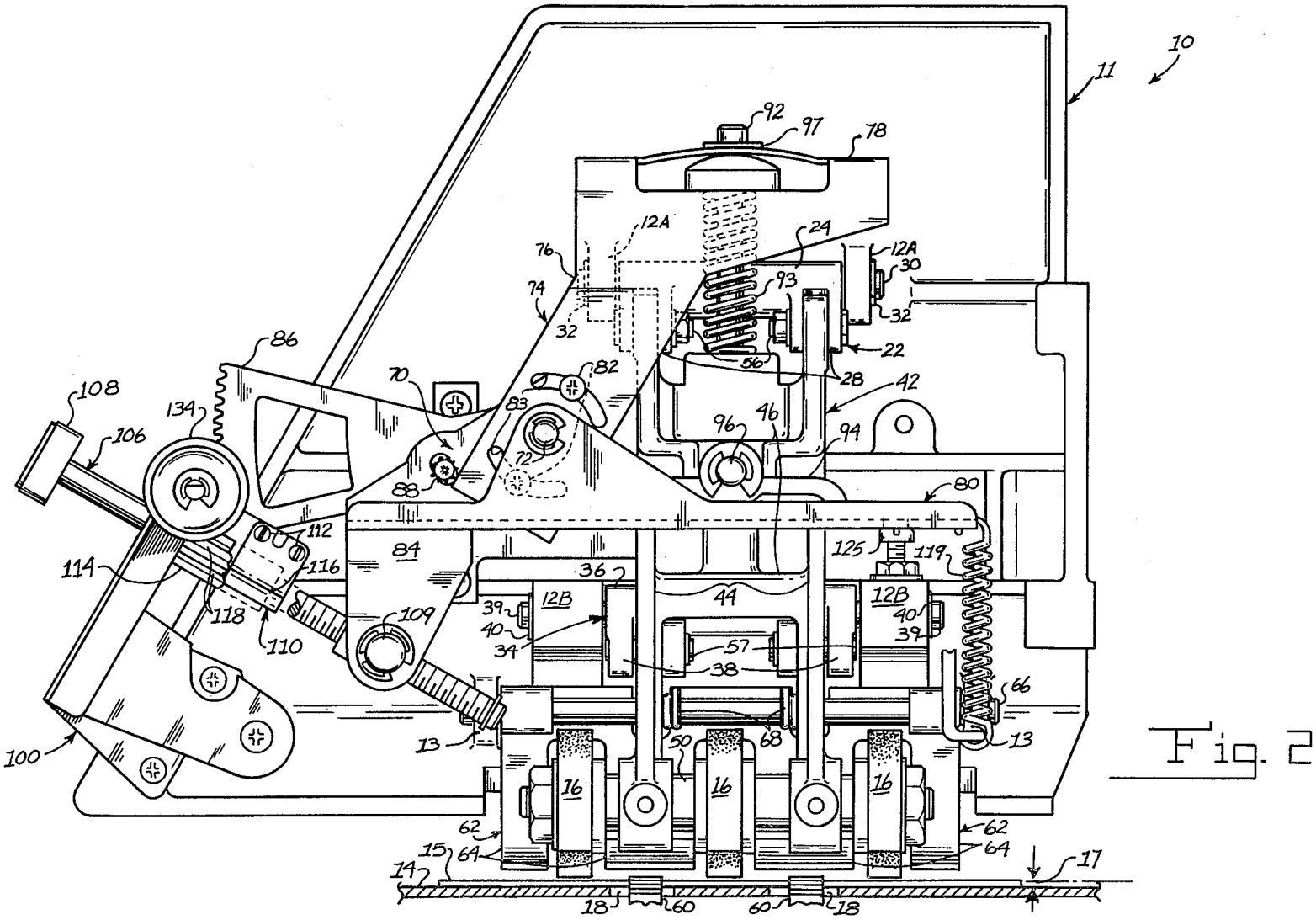
FIG. 2 is a side view, in elevation, of the apparatus of FIG. 1, including improved means for adjusting the sheet feeding gap, and showing a typical adjustment of the sheet separating stones above the deck so as to define a gap for feeding the sheets from a stack of sheets of substantially the same given thickness.

As shown in FIG. 1, the sheet separating and feeding apparatus 10, of the type which may be improved in accordance with the present invention, generally comprises a suitable housing 11 including a pair of upper supports 12A, a pair of intermediate supports 12B and a pair of lower supports 13 (FIG. 2).

The housing 11 (FIG. 1) supports the various components of the apparatus 10, including a feed deck 14 upon which a stack of sheets, including envelopes, circulars, currency, letters and documents, and the like, may be loaded. For illustration purposes there is shown a typical sheet 15 from such a stack of sheets. In addition, the housing 11 supports a plurality of upper, vertically-movable, sheet-separating, friction stones 16 in overhanging relationship with respect to the feed deck 14 so as to form a sheet feeding gap 17 (FIG. 2) between the stones 16 and deck 14. In practice, the feed gap 17 is ordinarily considered to be the shortest distance from the bottom of the stones 16 to the level of the upper surface of the feed deck 14. The feed deck 14 (FIG. 1) has a plurality of apertures 18 formed therein which are each spatially located substantially midway between the next adjacent sheet separating stones 16.

Figure 3:
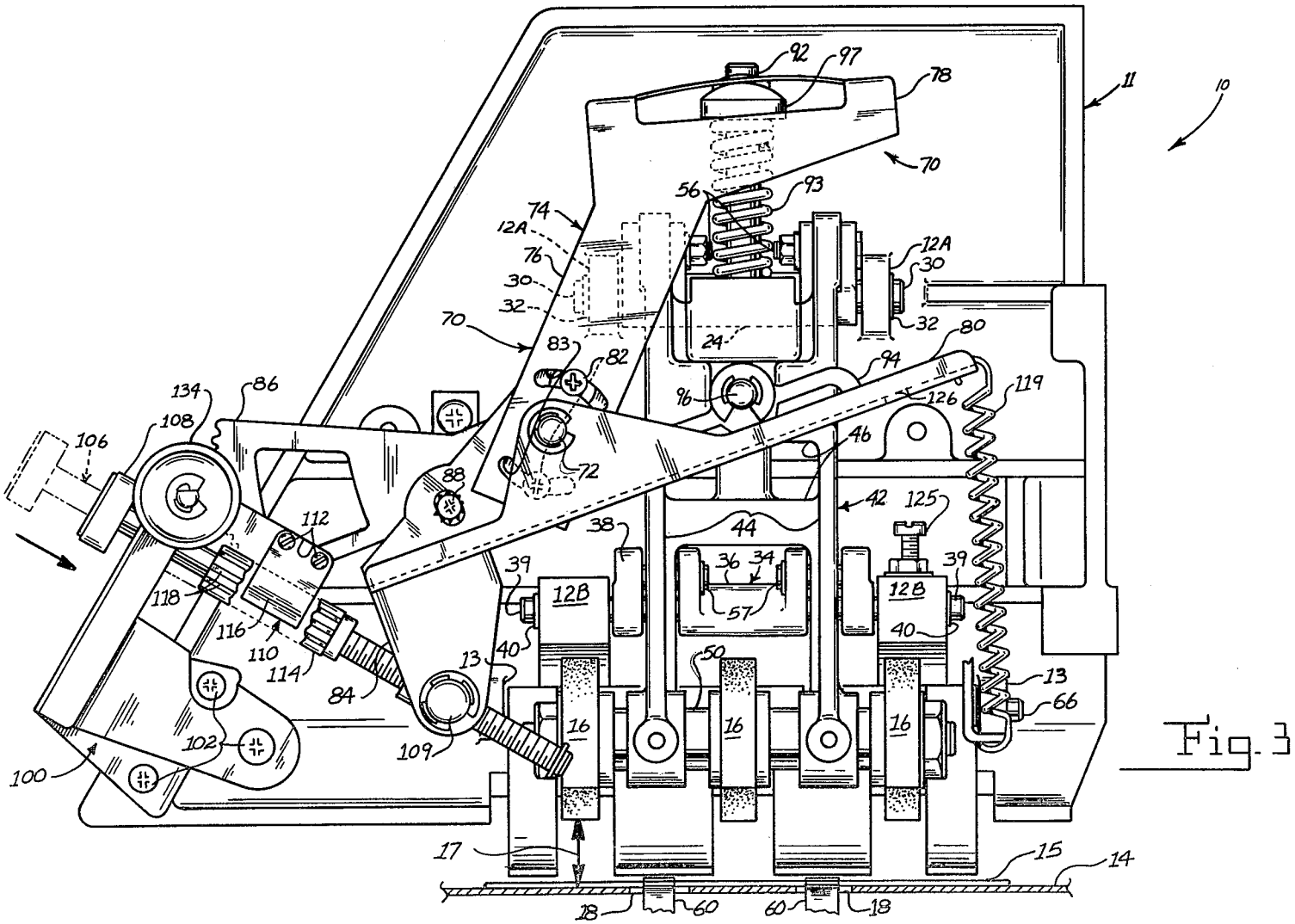
FIG. 3 is another side view, of the apparatus of FIG. 1, showing the sheet separating stones of FIG. 2 elevated for feeding a sheet which is thicker than those for which the sheet feeding gap has been adjusted for sheet feeding purposes.

For vertically movably connecting the sheet-separating stones 16 (FIG. 2) to the housing 11, the apparatus 10 includes a four-bar linkage system, the stationary base link of which comprises the housing 11 including the upper and intermediate supports, 12A and 12B. The linkage system also includes an upper link 22, which comprises a shaft portion 24 and a pair of parallel-spaced, forked, arms 28. The arms 28 extend from the shaft portion 24, and the upper link 22 extends between and is conventionally pivotably attached to the upper supports 12A, as by means of a suitable pin 30 and associated fasteners 32. In addition, the linkage system includes a lower link 34 (FIG. 3) which is in all respects the same as the upper link 22, and comprises a shaft portion 36 and a pair of parallel-spaced, forked, arms 38. The arms 38 extend from the shaft portion 36, and the lower link 34 extends between and is conventionally pivotably attached to the intermediate supports 12B, as by means of a pin 39 and fasteners 40. Further, the linkage systems includes a substantially vertically movable link 42 (FIG. 1) comprising a pair of substantially vertically-extending, parallel-spaced arms 44, and a pair of horizontally extending, upper and lower, parallel-spaced yokes 46 (FIG. 2). The yokes 46 extend between and ridgedly space the arms 44 from each other. In addition, the link 42 includes conventional means, such as a shaft 50 (FIG. 1) which is suitably adjustably-fixedly attached to the lower ends of the link arms 44 for carrying the sheet separating stones 15 in appropriately spaced relationship with respect to each other. And, the link 42 (FIG. 2) is conventionally pivotably attached to the upper and lower link arms 28 and 38, respectively, as by means of suitable pins 56 and 57, such that the upper and lower link arms, 28 and 38, extend substantially parallel to each other.

The apparatus 10 (FIG. 1) also includes a plurality of lower, sheet-feeding, friction rollers 60 which are known in the art as bump rollers. The sheet-feeding rollers 60 are aligned with the deck apertures 18 on a one-for-one basis. And each of the rollers 60 is suitably mounted for rotation by conventional means. The rollers 60 each includes a raised, substantially accurately-extending friction surface 61 which protrudes through the associated deck aperture 18 between the sheet separating stones 16 to engage the lowermost sheet 15 when the rollers 60 are rotated; as a result of which the sheets on top of the bottom sheet 15 are bumped upwardly as the bottom sheet 15 is fed downstream from beneath the stones 16.

In addition, the apparatus 10 (FIG. 1) includes a shield member 62 which includes a plurality of curvedly-extending, parallel-spaced fingers 64; and a shaft 66 (FIG. 2) which extends between and is suitably rotatably attached to the lower supports 13 for rotation of the shield member 62, and thus the fingers 64, toward and away from the feed deck 14. And, the apparatus 10 includes one or more springs 68, which are suitably connected to the housing 11 and to the shaft 66, for normally urging the shield member 62, and thus the fingers 64, toward the feed deck 14.

According to the invention, there is provided means for selectively setting, maintaining and otherwise controlling the height of the stones 16 above the deck 14, which, for discussion purposes, is referred to as the sheet feeding gap 17 (FIG. 2). The gap controlling means comprises a frame 70 which is conventionally pivotably attached to the housing 11 as by means of a pin 72. The frame 70 includes an upper arm 74. The upper arm 74 includes a shank portion 76 and a stop position 78. In addition, the frame 70 includes a normally substantially horizontally-extending lower arm 80. The upper arm 74 and lower arm 80 are conventionally secured to each other, as by means of a pair of adjustably fixable fasteners 82 (FIG. 1). The fasteners 82 through a like number of slots 83 formed in the upper arm's shank portion 76. The lower arm 80 includes an integrally connected, depending, bracket portion 84. The frame 70 also includes a segmented gear 86 (FIG. 1) which is conventionally secured to the lower arm 80, as by means of an adjustably fixable fastener 88 which extends through a slot 90 formed in the lower arm 80.

The frame 70 (FIG. 1) is connected to the stone carrying linkage system for raising and lowering the stones 16. And, to that end, the gap controlling means also comprises a stem 92 (FIG. 2) having its lower end conventionally threadably attached to the link 42; and its upper end connected to the upper arm's stop portion 78 so as to permit relative movement between the stem 92 and stop portion 78. The gap controlling means also includes a compression spring 93 and a lower arm follower 94. The spring 93 surrounds the stem 92 and has its lower end movably seated against the upper link yoke 46. The follower 94 is conventionally pivotably attached to the upper link yoke 46 as by means of a pin 96, and is slideably seated on the lower arm 80. A cap 97 is provided which loosely surrounds the stem 92, is movably seated against the upper end of the spring 93 and is slidably mounted within the upper arm's stop-portion slot 90. Inasmuch as the upper arm 74 is movably secured to lower arm 80, the fasteners 82 may be loosened in the slots 83 to facilitate interconnecting the frame 70 and linkage system and pre-compressing the spring 93. With this arrangement, whenever the frame 70 is pivoted about the pin 72, the lower arm 80 raises the follower 94 and thus the pin 96 and connected link 42, thereby raising the stones 16. The spatial relationship between the frame's upper-arm stop portion 78 and lower arm 80, reamins constant as the frame 70 is pivoted. Thus the spring 93 is not compressed in response to pivotal movement of the frame 70. On the other hand, the spring 93 is compressed the same distance in response to the stones 16 being raised a given height, whenever a sheet 15 exceeds the width of the gap 17 by the aforesaid given height, independently of any differences there may be in the preselected setting of the gap 17.

For selectively adjusting the gap 17 (FIG. 2) there is provided a bracket 100 which is conventionally fixedly attached to the housing 11, as by means of a fasteners 102. The gap adjusting means also comprises a shaft 106, which is conventionally connected to the bracket 100 for rotation in place, and includes a knob 108 extending from its free end for operator manipulation purposes. The other end of the shaft 106 is threaded, and is threadably engaged with a clevis pin 109 which is rotatably mounted in the frame's depending bracket portion 84. As the shaft 106 is rotated, the clevis pin 109, and thus the bracket arm portion 84, is moved toward or away from the bracket 100, depending on the direction of rotation of the knob 108. As a result, the frame 70 is rotated about the pivot pin 72; thereby raising or lowering the follower 94 and connected pin 96 and link 42; thereby raising or lowering the stones 16 to a selected height above the deck 14.

In the event that a sheet 15 (FIG. 2) is too thick for feeding through a given preselected gap 17, the operator may override the gap adjusting means to permit such thicker sheets 15 to be fed beneath the stones 16. To that end, the gap controlling means includes a detent spring 110, which is conventionally fixedly attached to the bracket 100 as by means of a pair of fasteners 112, and includes a collar 114 which is fixedly mounted on the gap selecting shaft 106. The detent spring 110 has formed therein an elongated ridge 116, and the collar 114 has formed in its peripheral surface a plurality of longitudinally extending grooves 118. Preferably, eight of such grooves 118 are provided at equidistantly-spaced intervals circumferentially of the collar 114. In addition, there is provided a tension spring 119 having one end connected to the frame's lower arm 80 and the other end conventionally connected to the housing 11. As shown in FIG. 2, the detent spring's ridge 116 is normally aligned with and disposed in engagement with one of the collar's grooves 118. As the gap selecting shaft 106 is continuously rotated, the detent spring's ridge 116 rides upon, and is spring loaded against, the rotating collar 114. When the operator wishes to override the gap selecting means to raise the stones 16 sufficiently to feed a thicker sheet 15, the knob 108, and thus the shaft 106, is pushed against the depending bracket 84 for doing so. This results in movement of the shaft 106, from for example the position shown in FIG. 2 to the position shown in FIG. 3. Concurrently, the frame 70 rotates against the tension of the spring 119, about the pin 72, for raising the stones 16 to the position shown in FIG. 3. Since the detent spring ridge 116 is normally located in engagement with one of the collar's grooves 118 when the gap 17 is selected; the shaft 106 does not rotate when it is pushed as hereinbefore described. Rather the collar 114 slides downwardly on the detent spring's ridge 118 and is thereby constrained from rotation. After the thicker sheet 15 has been fed beneath the stones 16, the operator releases the knob 108; whereupon the spring 119 lowers the frame's lower arm 80, and thus the frame 70, thereby returning the stones 16 to the preselected height at which they were disposed prior in time to raising the same. In practice, the gap selecting structure and stone carrying linkage system are dimensioned such that rotation of the collar 114 through an arc defined by the distance between any two next adjacent grooves 118, results in raising or lowering the stones 16 approximately fifty-thousandths of an inch, depending on the direction of rotation of the shaft 106. And, the longitudinal length of the detent spring's ridge 116 and the respective grooves 118 are chosen to be sure that the width of the selected gap 17 is not changed when the operator pushes the shaft 106 to lift the stones 16 for feeding a thicker sheets 15 beneath the same.

In addition to the foregoing, the gap selecting structure preferably includes suitable means for limiting the extent to which the frame 70 (FIG. 2) may lower the stones 11 relative to the deck 14. To that end, there is provided a conventional, adjustably-fixable, lower-limit stop 125, which is connected for example to the intermediate support 12B; and the frame's lower arm 80 includes an opening 126 which is aligned with the stop 125 to provide access for adjusting the height of stop 125. When the frame 70 is rotated against the tension of the spring 119, by pushing the knob 108, to permit thicker than usual sheets 15 to be fed beneath the stones 16; the maximum height the stones 16 may be so raised (FIG. 3) is limited by the stones 16 contacting the underside of the intermediate supports 12B. And, when the knob 108 (FIG. 2) is released, the lowest level to which the stones 16 may be lowered is limited by the underside of the frame's lower arm 80 contacting the stop 125.

To provide the operator with a visual indication of the gap width 17 (FIG. 2) the gap selecting structure includes a shaft 130 (FIG. 1) which is mounted for rotation in the bracket 100; a gear 132, which is fixedly attached to one end of the shaft 130 and mounted in intermeshing relationship with the gear 86; and a wheel 134, which is fixedly attached to the other end of the shaft 130. The wheel 134 is provided with suitable markings 136, for example, the integers zero through ten for indicating the relative height in fifty-thousandths of an inch increments of the stones 16 above the deck 14. In practice, the zero marking is aligned with a level indicator, such as an arrow on line (not shown) which is marked on the housing 11. With this arrangement, assuming the lower limit stop 125 has been adjusted, the gear 86 may be rotated about the fastener 88, in intermeshing relationship with the gear 86, until the zero marking on the wheel 134 is aligned with the aforesaid marking on the housing 11; whereupon the fastener 88 may be tightened to fix the relationship between the marking on the wheel 134 and the height of the stones 16 with respect to the deck 14.

In accordance with the objects of the invention there has been described improved sheet separating and feeding apparatus, and, more particularly, improved means for adjusting the sheet feeding gap between the sheet separating stones and feed deck and means for rapidly raising the stones to accommodate feeding thicker-than-usual sheets.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. In apparatus for separating and feeding sheets, wherein said apparatus includes a sheet feeding deck, a sheet separating stone and means for carrying the stone in overhanging relationship with respect to the deck, improved means for controlling the height of the stone above the deck, said controlling means comprising:

(a) frame means connected to said stone carrying means for movement thereof and thus of said stone;

(b) means for adjusting the height of the stone above the deck, said height adjusting means including a shaft having a free end and threadably engaging the frame means, said shaft adapted to be manually rotated for moving said frame means to move said stone to a selected height above said deck; and (c) means for overriding said adjusting means, said overriding means including manually pushable means extending from the free end of the shaft for permitting said shaft to be manually pushed for movement of said shaft without rotation thereof to raise said stone above said selected height, said overriding means including a collar fixedly attached to said shaft for movement therewith, and said overriding means including spring means cooperative with said collar for constraining rotation of said shaft when said shaft is pushed.

2. The controlling means according to claim 1, wherein said frame means includes a spring and a lower arm connected to said carrying means, and said frame means including an upper arm fixedly attached to said lower arm and against which said spring is compressed in response to movement of said stone carrying means by a sheet of greater thickness than said selected height.

3. The controlling means according to claim 2, wherein said upper arm is adjustably fixedly connected to said lower arm for pre-compressing said spring.

4. The controlling means according to claim 1, wherein said frame means is mounted for pivotal movement and includes a clevis pin, and said shaft threadably engaging said clevis pin for pivotal movement of said frame means in response to rotation of said shaft.

5. The controlling means according to claim 4, wherein said frame means includes a gear segment therefrom, and said controlling means including means engaging said gear segment and movable thereby for indicating the relative height of the stone above the deck.

6. The controlling means according to claim 1 including a spring, and said frame means including an arm connected for lifting said stone carrying means in response to pushing said shaft, and said spring connected for lowering said arm in response to releasing said shaft after pushing.

7. The controlling means according to claim 6, wherein said spring is a tension spring, and said arm is connected for lifting said stone carrying means against the tension of said spring.

8. Apparatus for separating and feeding sheets, comprising: (a) a sheet feeding deck; (b) a sheet separating stone; (c) means for carrying the stone in overhanging relationship with respect to the deck; (d) a movable frame connected to the stone carrying means; (e) a shaft having a free end, knob means mounted on the free end of the shaft and manually rotatable for rotating said shaft, said shaft threadably engaging the frame for movement thereof to move the stone to a selected height above said deck when said shaft is rotated; and (f) means for permitting the shaft to be manually pushed for movement of said shaft without rotation thereof thereby raising the stone above the selected height, said means for permitting including a collar and spring means cooperative with each other for constraining rotation of said shaft when said shaft is pushed.

* * * * *